US006668422B2

(12) United States Patent
Tolmei

(10) Patent No.: US 6,668,422 B2
(45) Date of Patent: Dec. 30, 2003

(54) SAFETY DEVICE TO PREVENT THE UNINTENTIONAL CLOSING OF A VEHICLE'S TRUNK OR HOOD LID

(76) Inventor: Ron Tolmei, 5258 Grasswood Ct., Concord, CA (US) 94521

( * ) Notice: Subject to any disclaimer, the term of this patent is extended or adjusted under 35 U.S.C. 154(b) by 0 days.

(21) Appl. No.: 10/023,112

(22) Filed: Dec. 13, 2001

(65) Prior Publication Data

US 2003/0110590 A1 Jun. 19, 2003

(51) Int. Cl.[7] ..... E05F 5/02
(52) U.S. Cl. ..... 16/82; 16/347; 217/60 E
(58) Field of Search ..... 16/82, 83, 319, 16/343, 346, 374, 376, DIG. 17, 347

(56) References Cited

U.S. PATENT DOCUMENTS

| | | | | | |
|---|---|---|---|---|---|
| 1,324,435 | A | * | 12/1919 | Scotford | 217/60 C |
| 2,125,247 | A | * | 7/1938 | Roethel | 217/60 E |
| 2,126,579 | A | * | 8/1938 | Roethel | 16/347 |
| 2,707,064 | A | * | 4/1955 | Castello | 217/60 R |
| 3,180,668 | A | * | 4/1965 | Brown | 292/276 |
| 4,291,501 | A | * | 9/1981 | Steinberg et al. | 49/386 |
| 4,419,789 | A | * | 12/1983 | Matsui et al. | 16/308 |
| 4,460,105 | A | * | 7/1984 | Cox | 220/830 |
| 4,524,496 | A | * | 6/1985 | Tehsildar et al. | 27/18 |
| 4,771,505 | A | * | 9/1988 | Dilich | 16/86 A |
| 4,811,440 | A | * | 3/1989 | Scott | 7/100 |
| 4,925,230 | A | * | 5/1990 | Shelton | 296/76 |
| 5,029,941 | A | * | 7/1991 | Twisselmann | 297/411.38 |
| 5,244,273 | A | * | 9/1993 | Kaspar et al. | 312/405 |
| 5,358,225 | A | * | 10/1994 | Volpel et al. | 267/64.12 |
| 5,516,168 | A | * | 5/1996 | Tomaszewski-Link | 292/338 |
| 5,551,738 | A | * | 9/1996 | Thorlton | 292/262 |
| 5,570,493 | A | * | 11/1996 | Gulick | 27/18 |
| 5,784,968 | A | * | 7/1998 | MacDonnell | 105/26.05 |
| 5,862,570 | A | * | 1/1999 | Lezuch et al. | 16/82 |
| 6,048,005 | A | * | 4/2000 | Rotondi | 292/262 |
| 6,086,958 | A | * | 7/2000 | Russell et al. | 427/385.5 |
| 6,209,932 | B1 | * | 4/2001 | Jung et al. | 292/216 |
| 6,428,062 | B1 | * | 8/2002 | Roehl | 292/339 |
| 2002/0000022 | A1 | * | 1/2002 | Schillaci et al. | 16/319 |

FOREIGN PATENT DOCUMENTS

| | | | | |
|---|---|---|---|---|
| JP | 03115681 | A | * 5/1991 | E05D/11/06 |

* cited by examiner

*Primary Examiner*—J. J. Swann
*Assistant Examiner*—Thomas Ho

(57) ABSTRACT

A device used to safely secure a vehicle's trunk or hood lid, hereafter called lid or lids, in an open position is disclosed. The preferred device comprises a ⊔ formed fork, which is housed in a vehicle's existing lid support arms, with two ends; two force distribution boots, two friction fittings and a damping-extension block. Upon manual engagement of the fork assembly the two force distribution boots contact the damping-extension block and keep a vehicle's lid from closing. Most vehicles have spring tension assemblies mounted in their lids that operate to keep the lids open by way of stored energy in the spring assemblies. As such, lids equipped with these spring assemblies are subject to unintentional closing by unexpected forces, such as winds, parking a vehicle on a grade or often accidents related to children. In the present invention, the device's flawless operation is entirely independent and void of these actions owing to its design, stability, and simplicity of operation.

7 Claims, 2 Drawing Sheets

SAFETY DEVICE TO PREVENT THE UNINTENTIONAL CLOSING OF A VEHICLE'S TRUNK OR HOOD LID

CROSS REFERENCE TO RELATED APPLICATIONS

References Cited
U.S. Patent Documents

| | | | |
|---|---|---|---|
| 2671355 | March, 1954 | Hawkins | 74/532. |
| 2685353 | August, 1954 | Caskie | 403/108. |
| 4070050 | January, 1978 | Glock et al. | 292/339. |
| 4667993 | May, 1987 | Hannesson et al. | 292/339. |
| 5238213 | August, 1993 | Pool | 248/352. |
| 6029941 | Feb. 29, 2000 | Mayzes | 248/352. |
| 5647619 | July, 1997 | DeLisio | 292/288 |

BACKGROUND OF THE INVENTION

1. Field the Invention

The present invention relates to a restraint for vehicle trunks or hoods, hereafter called lid or lids, and in particular for restraints that serve as safety back-up systems. This invention is to hold a lid open in order to prevent their unintentional closing by unanticipated forces, such as: winds, parking a vehicle on an excessive grade, aging hood or trunk retention assemblies or accidents often associated with children.

2. Discussion of Background

Vehicle lids have long been a cause of injury, sometimes death, by their unintentional closings at inopportune times. These random closing's, seemingly on their own volition, are often caused by unanticipated forces such as: winds, parking a vehicle on an excessive grade, aging hood/trunk retention assemblies or accidents often associated with children. Previously the automotive industry has addressed this problem by having a physical rod, manually placed into position, prop the lid assembly into an open position. Today automobile manufacturers utilize pistons or spring retention assemblies to keep lids into an open position. The inherent problems associated with these systems is that they are highly susceptible to failure owing to aging of the retention assemblies, such as pistons leaking, springs losing their energy storage capabilities, or unexpected forces being exerted upon them or inadvertent closings.

Additionally the current lid mechanisms used today are designed to perform a duality of functions, i.e. closing and opening, whereas earlier lid retention devices, rods, were designed with one goal in mind—to keep the lid open. This duality of function results in a paradox such that neither function, opening or closing, is designed for optimum performance due to conflicting functions.

Furthermore, owing to costs and the number of vehicles manufactured each year, somewhere around 500,000 per manufacturer, the automobile industry is unlikely, at best hesitant, to have a lid retention system uniquely designed for every manufacturers' make and model. And finally, probably the most important issue owing to the possibility of a national recall, manufacturers do not want a solution that cannot cost-effectively retrofit a variety of previously manufactured vehicles.

Therefore as exemplified, the most important considerations in developing a safety device to minimize the probability that a lid will not inadvertently close are: cost, its capability of providing a universal solution, its ability to retrofit existing vehicles and the simplicity of operation—all of which this present invention uniquely satisfies.

BRIEF SUMMARY OF THE INVENTION

Accordingly with its major aspects already briefly recited, the present invention is a back-up safety device for holding a vehicle's trunk or hood, hereafter called lid or lids, in an open position. The device comprises a ⊔ formed fork, which is housed in a vehicle's lid support arm, and swung into contact with an extension-damper assembly whenever it is desired to keep the lid open. One end of the ⊔ formed fork is inserted into friction fittings on both sides of the support arm and the other end bent such that the ⊔ formed fork now has one leg of the fork on each side of the support arm assembly. Both ends of the ⊔ formed fork are fitted with force distribution boots such that when the ⊔ formed fork is manually swung down they come in contact with the extension-damper assembly that is mounted to the lids interior well. When this happens the ⊔ formed fork ends force distribution boots come in contact with the extension-damper which in turn is connected to the vehicles body assembly and does not allow the lid to move towards the closed position. Two important, related features of the present invention are as follows: When the ⊔ formed fork is in the up, storage position, it is kept there by the frictional forces exerted by the two friction fittings, and does not inhibit the opening or closing of the vehicle's lid. Secondly the function of the extension-damper is two fold. Because when swung down the ⊔ formed fork must clear the vehicles body assembly it could, without the extension-damper, allow the lid to move in the downward direction some distance before making contact with the vehicles body assembly. Although the ⊔ formed fork, without the extension-damper, would not allow the lid to fully close the displacement, that is a function of a particular vehicle, could be sufficient to hit a person's head before stopping the movement. Therefore, one function of the extension damper is to in-effect lengthen each length of the ⊔ formed fork such that there is minimal movement of the lid before the ⊔ formed fork's force distribution boots make contact with it and stop movement. The second function of the extension-damper is to dampen and absorb the energy of the lid's movement when inadvertently tying to close when the safety device is enabled in the down position. Other features and their advantages will be apparent to those skilled in the art of lid supports from a careful reading of the Detailed Description of Preferred Embodiments accompanied by the following drawings.

DETAILED DESCRIPTION OF THE INVENTION

The present invention is a device for use in securing a lid in an open position. Most lids use either springs or pistons as dual-purpose devices to keep the lids open and secondarily as an aid in closing. One part of the lid assembly is connected to the lid by one end of a support arm and the other part, the body of the vehicle, is connected to the other end of the lid support arm. When a lid is opened the springs or pistons supply the energy to keep the lid from closing and when the lid is to be closed the energy in the springs or pistons releases this energy aiding the closing. For simplicity in this description, however, it will be assumed that lid is synonymous with hood or trunk and the present device would operate in the same fashion as described.

Figure 1:
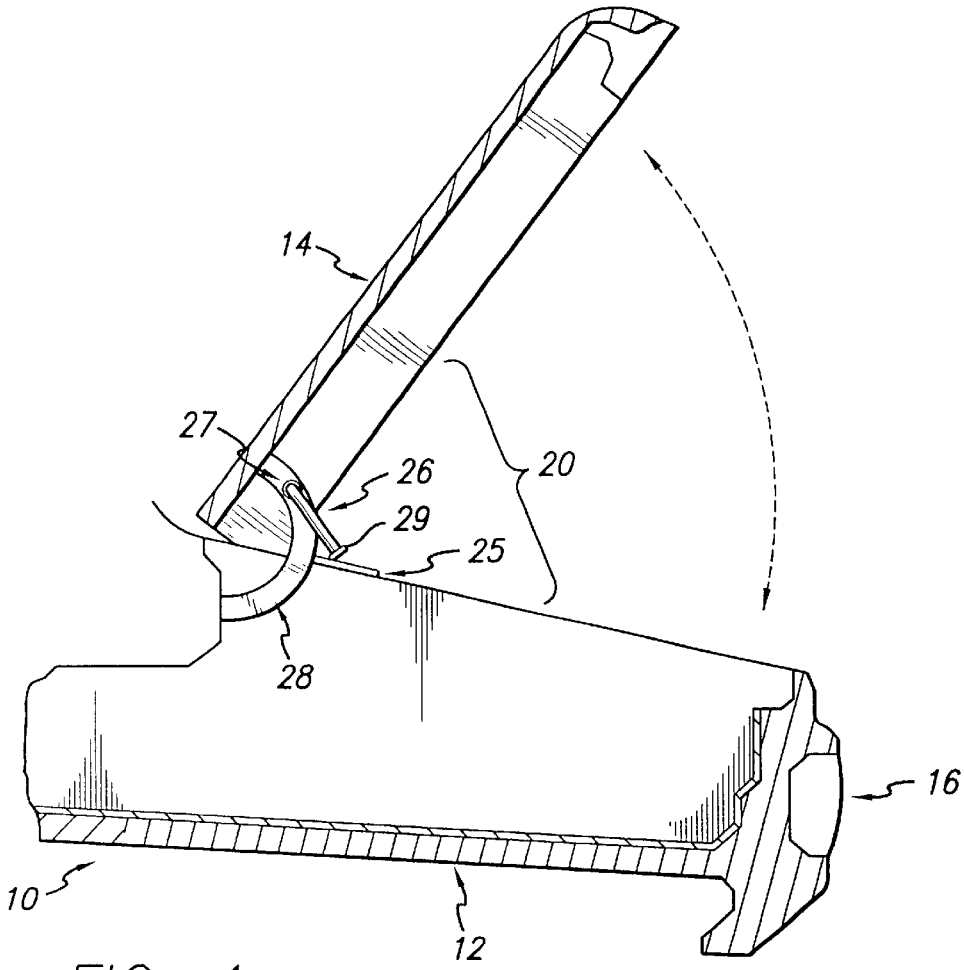
FIG. 1 is a side cross-sectional view of a portion of a vehicle showing the lid area with the lid open and the device in place to secure the lid in that open position, according to a preferred embodiment of the present invention.

FIG. 1 shows the rear portion of a vehicle generally indicated with reference number 10 vehicle 10 has a body 12 and a lid 14, here shown in an open position. The rear, or front, of the vehicle is indicated by reference number 16 and lid sill by reference number 25 and the lids support arm 28. Device 20 according to a preferred embodiment of the present invention is shown holding lid 14 in the open position. Device 20 comprises a ⊔ formed rod 26 having, in this embodiment, one section threaded through holes in the lids support arm assembly, a damper-extension 18, two force distribution boots 29, and two friction fittings 27. To keep the lid in an open position the ⊔ formed rod 26 is swung down into contact with damper-extension 18 which is secured in the lids sill 25.

Figure 4:
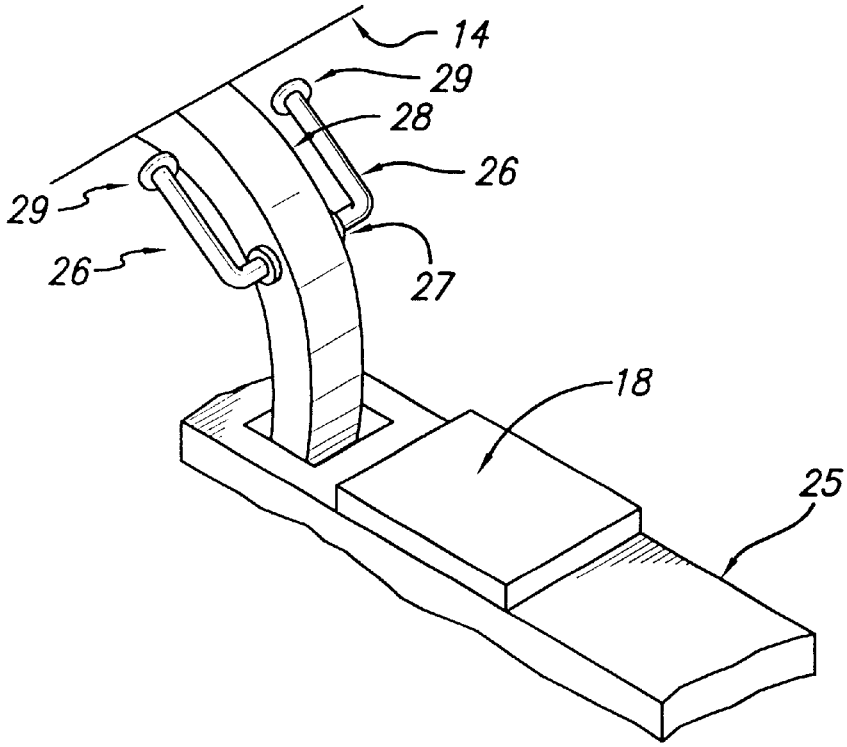
FIG. 4 shows a front view of the device in the storage position on the vehicles support arm.

When it is desired to close the lid the ⊔ formed rod 26 is swung up into a storage position adjacent to the lids support arm as indicated in FIG. 4 and secured there by frictional forces supplied by two friction fittings 27.

There are, of course, numerous ways of implementing the ⊔ formed rod and associated components. These include springs, cams, detent mechanisms, locks, nuts, various other forms of rods, and numerous other devices. Therefore, the present invention is not limited to the embodiment shown, but includes any mechanism for fixing the position of a rod, tube, or likeable member from a support arm assembly to any part vehicle that would constrain the movement of a lid.

Figure 2:
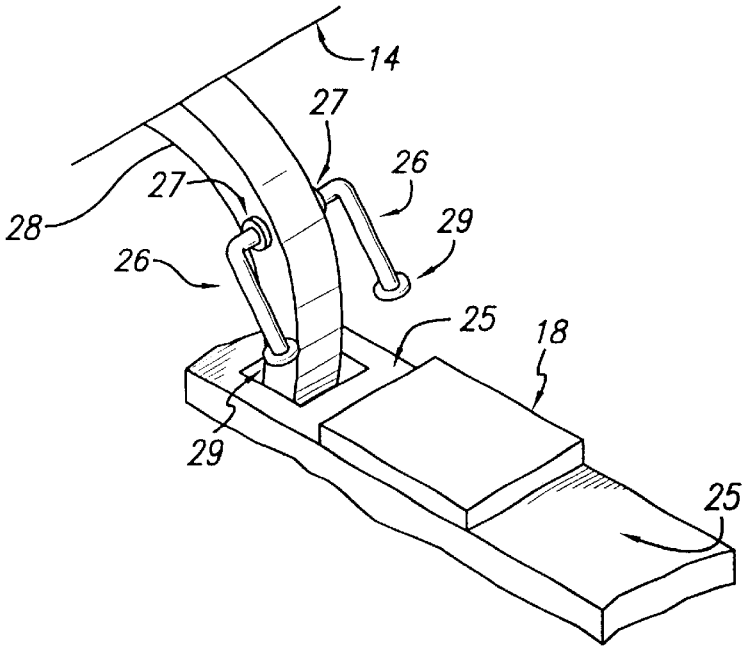
FIG. 2 shows a front view of the device after being swung into position and just before it contacts the extension-damper housed on the sill of the lid that will inhibit any further movement of the lid, according to a preferred embodiment of the present invention.

FIG. 2 illustrates details of device 20, namely, a ⊔ formed rod 26 having, in this embodiment, one section threaded through holes in the lids support arm assembly, a damper-extension 18, two force distribution boots 29, and two friction fittings 27. When the ⊔ formed rod 26, as shown, has been swung down into position it makes contact with damper-extension 18, that is secured to the vehicles body sill 25, via two force distribution boots 29 thereby constraining any further movement of the lid.

Figure 3:
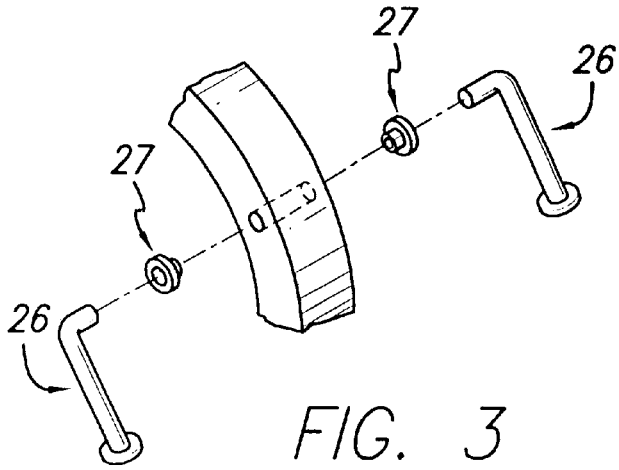
FIG. 3 shows an expanded view of FIG. 2 showing the friction bushings and holes of the support arm assembly

FIG. 3 illustrates another detail of device 20, namely, a ⊔ formed rod 26 having, in this embodiment, one section threaded through holes in the lids support arm assembly, the second being two friction fittings 27 that provide the isolation of the ⊔ formed rod 26 from the holes in the support arm assembly 28 and provide the frictional forces to keep the ⊔ formed rod 26 in the up position for storage as shown in FIG. 4.

FIG. 4 illustrates details of device 20, namely, a ⊔ formed rod 26 having, in this embodiment, one section threaded through holes in the lids support arm assembly, a damper-extension 18, two force distribution boots 29, and two friction fittings 27. When the ⊔ formed rod 26, as shown, has been swung up into storage position it is secured in this position by two friction fittings 27.

To use device 20 as a safety protection device to prevent the inadvertent closing of a lid swing down ⊔ formed rod 26 as shown in FIG. 2 into position where it makes contact with damper-extension 18, that is secured to the vehicles body sill 25, via two force distribution boots 29 and thereby constrains any further movement of the lid.

Device 20's ⊔ formed rod 26 is preferably made of metal, but for most vehicles, any reasonably rigid material will do, including some plastics such as nylon and composites such as graphite or fiberglass impregnated polymers. Additionally, device 20's damper-extension 18, force distribution boots 29, and friction fittings 27 are preferably made of rubber but for most vehicles, any reasonably resilient material will do, including some plastics such as nylon and composites such as graphite or fiberglass impregnated polymers. It is readily apparent to those skilled in the art of lid supports from reading the foregoing that many substitutions and modifications may be made to the preferred embodiments described without departing from the spirit and scope of the present invention.

What is claimed is:

1. A device for holding a trunk or hood lid of a vehicle having a lid retention assembly comprised of springs, rods or pistons in an open position, said device comprising of:

A U-shaped formed rod having a first leg with a first free end, said first free end being fitted with a first force distribution boot, said formed rod having a second leg with a second free end, said second free end fitted with a second force distribution boot; said first leg having a first fixed end attached to a first side of a medial portion, and said second leg having a second fixed end attached to a second side of said medial portion opposite said first side; said medial portion extending substantially perpendicularly to the longitudinal axes of said first and second legs; said U-shaped formed rod being inserted through a pair of friction fittings inserted into first and second holes so that said rod is pivotally attached a vehicle lid hinge arm; said first hole being located on one surface of said vehicle lid hinge arm, and said second hole being located on an opposing surface of said vehicle lid hinge arm such that said medial portion extends through said friction fittings and said first and second holes; wherein said U-shaped formed rod is manually movable into a lowered position, such that said first and second force distribution boots make contact with a damper-extension that is mounted on a sill portion of said vehicle frame opposite said vehicle lid, thus prohibiting movement of said lid.

2. The device as recited in claim 1, further comprising two friction fittings as a means for retaining the formed rod in a storage position and providing mechanical isolation of said rod through a pair of holes with one hole on one side of a lid's support arm of the vehicle with said other hole being on the opposite side of said lid support arm.

3. The device as recited in claim 1, wherein said friction fittings being comprised of molded material fitted into said holes in the lids support arms with material being sufficient to provide frictional forces necessary to retain the formed rod in a storage position and provide mechanical isolation of said formed rod from vehicles support arms.

4. The device as recited in claim 1, further comprising two force distribution boots as a means of distributing lid closing forces on the damper-extension assembly and providing frictional forces to prevent movement of the formed rod on the damper-extension assembly.

5. The device as recited in claim 1, wherein said force distribution boots comprised of force resilient material with a coefficient of friction sufficient to prevent slipping of the formed rod on the damper-extension assembly and molded to fit the ends of the said formed rod.

6. The device as recited in claim 1, further comprising a damper-extension as a means for adjusting the height of the lid at which the protection is enabled and providing damping to remove excess energy from the formed rod.

7. The device as recited in claim 1, wherein said damper-extension comprises:

a molded assembly comprised of a force resilient material with a coefficient of friction sufficient to prevent slipping of the formed rod on the damper-extension assembly having dimensions appropriate to accommodate filling the sill space necessary to disable lid movement when said formed rod device is in contact with said damper-extension.

* * * * *